US006815890B2

(12) United States Patent
Tsai et al.

(10) Patent No.: US 6,815,890 B2
(45) Date of Patent: Nov. 9, 2004

(54) PLASMA DISPLAY PANEL WITH COMMON DATA ELECTRODES

(75) Inventors: Chung-Kuang Tsai, Hsinchu (TW); Yao-Ching Su, Taoyuan (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 10/700,002

(22) Filed: Nov. 3, 2003

(65) Prior Publication Data

US 2004/0100195 A1 May 27, 2004

(30) Foreign Application Priority Data

Nov. 25, 2002 (TW) ..... 91134238 A

(51) Int. Cl.[7] ..... H01J 17/49
(52) U.S. Cl. ..... 313/584; 313/585
(58) Field of Search ..... 313/584, 585, 313/586

(56) References Cited

U.S. PATENT DOCUMENTS 4,518,894 A * 5/1985 Andreadakis ..... 313/491
6,242,860 B1 * 6/2001 Sasao et al. ..... 313/586

* cited by examiner

*Primary Examiner*—David Vu
(74) *Attorney, Agent, or Firm*—Thomas, Kayden, Horstemeyer & Risley

(57) ABSTRACT

The invention provides a plasma display panel including a number of first display units and a number of second display units, wherein the first and second display units are composed of plural sustaining electrodes, scanning electrodes, data electrodes. The sustaining electrodes and scanning electrodes form at least two adjacent electrode combinations, namely the first electrode combination and the second electrode combination, wherein each electrode combination includes one sustaining electrode and one scanning electrode. Data electrodes are disposed along a direction approximately orthogonal to these sustaining electrodes and scanning electrodes. The first display unit corresponds to the first primary color and is controlled by the first data electrode and the first electrode combination while the second display unit corresponds to the second primary color and is controlled by the first data electrode and the second electrode combination. The first display unit and the second display unit are adjacent and alternately arranged.

21 Claims, 8 Drawing Sheets

PLASMA DISPLAY PANEL WITH COMMON DATA ELECTRODES

This application claims the benefit of Taiwan application Serial No. 091134238, filed Nov. 25, 2002.

BACKGROUND OF THE INVENTION

1. Field of the Invention

The invention relates in general to a plasma display panel, and more particularly to a plasma display panel with common data electrodes.

2. Description of the Related Art

Plasma display panel (PDP) whose display characteristics are far better than that of cathode ray tube (CRT) due to the features of big size, wide view angle, high resolution and full-colored image display etc., has drawn considerable attention in recent years.

Refer to FIG. 1, which is a three-dimensional diagram of a conventional plasma display panel. The plasma display panel includes a front substrate 102 and a rear substrate 108 with a number of alternately arranged sustaining electrodes X and scanning electrodes Y being disposed on the front substrate 102 wherein a number of transparent electrodes (not shown) can be formed and defined before the formation of the above sustaining electrodes X and scanning electrodes Y. The transparent electrodes whose patterns are determined according to their designs would not be described in detail. The above sustaining electrodes X and scanning electrodes Y are covered by a dielectric layer 104, while the dielectric layer 104 is covered by a protection layer 106, which is composed of magnesium oxide and is used to protect sustaining electrodes X, scanning electrodes Y and the dielectric layer 104. Moreover, a number of data electrodes A are disposed on the rear substrate 108 and are covered by a dielectric layer 116, wherein data electrodes A are orthogonal to sustaining electrodes X and scanning electrodes Y A number of barrier ribs 112 are disposed on the rear substrate 108 along the direction of data electrodes A with a number of fluorescent layers 110 covering between every two adjacent barrier ribs 112.

The cavity between the front substrate 102 and the rear substrate 108 is a discharge space filled with discharge gas, which is a mixture of neon and xenon. A display unit is defined by a sustaining electrode X and a scanning electrode Y, both are disposed on the front substrate 102, together with their corresponding data electrode A, which is disposed on the rear substrate 108. Therefore, a number of display units arranged in matrix can be defined on a plasma display panel by the sustaining electrodes X, scanning electrodes Y and data electrodes A. By exciting the gas in the discharge, the excited gas will emit ultraviolet rays. The fluorescent layer 110 will emit visible light after absorbing ultraviolet rays of specific wavelengths.

Refer to FIG. 2, a schematic diagram illustrating the relation between several display units of horizontal arrangement and each electrode in the plasma display panel shown in FIG. 1. Display units of different colors can be obtained by forming fluorescent layers corresponding to different colors between adjacent barrier ribs. As shown in FIG. 2, data electrodes A1, A2 and A3 are used to control red display units R1 and R2, green display units G1 and G2, blue display units B1 and B2 respectively. The driving method for these display units includes the following steps. First, during an erasing period, erase displaying data for all display units. Next, during an addressing period, sequentially scan scanning electrodes Y1 and Y2, and select the display units to be lighted by enabling data electrodes A1 to A3. After that, during a discharge sustaining period, the selected display units will be lighted continuously by providing an alternating voltage between the sustaining electrode X1 and scanning electrode Y1, and the sustaining electrode X2 and scanning electrode Y2.

In addition to the display unit of horizontal arrangement as shown in FIG. 2, display units can also be disposed in triangle arrangement. Refer to FIG. 3, a schematic diagram illustrating a conventional relations between several display units of triangle arrangement and each electrode. The display units of triangle arrangement are achieved by means of honeycomb type barrier ribs 302. Take the adjacent and alternately arranged display units green display unit G2 and red display unit R3 for example. Green display unit G2 is controlled by data electrode A2 and scanning electrode Y1 while red display unit R3 is controlled by data electrode A1 and scanning electrode Y1. When scanning electrode Y1 is scanned, green display unit G2 and red display unit R3 can be respectively selected by data electrodes A1 and A2.

Conventionally, the adjacent and alternately arranged display units must be controlled by different data electrodes, so a large number of data electrodes are required in order to control display units. Since a large number of data electrodes are required, the cost of a conventional plasma display panel is increased. Besides, the manufacturing process becomes more complicated due to the narrow space between adjacent data electrodes.

SUMMARY OF THE INVENTION

It is therefore an object of the invention to provide a plasma display panel, which controls two adjacent and alternately arranged display units using common data electrodes. By reducing the required number of data electrodes, the manufacturing cost can be further lowered.

It is therefore an object of the invention to provide a plasma display panel including a plurality of sustaining electrodes, scanning electrodes, data electrodes, the first display unit and the second display unit. These sustaining electrodes and scanning electrodes form at least two adjacent electrode combinations, namely the first electrode combination and the second electrode combination, wherein each electrode combination includes a sustaining electrode and a scanning electrode. Data electrodes are disposed along a direction approximately orthogonal to these sustaining electrodes and scanning electrodes. The first display unit corresponds to the first primary color and is controlled by the first data electrode and the first electrode combination while the second display unit corresponds to the second primary color and is controlled by the first data electrode and the second electrode combination, wherein the first display unit and the second display unit are adjacent and alternately arranged.

Other objects, features, and advantages of the invention will become apparent from the following detailed description of the preferred but non-limiting embodiments. The following description is made with reference to the accompanying drawings.

DETAILED DESCRIPTION OF THE INVENTION

The spirit of the invention lies in using a data electrode to control two adjacent and alternately arranged display units to reduce the required number of data electrodes and further lower the manufacturing cost down.

The First Embodiment

Figure 1:
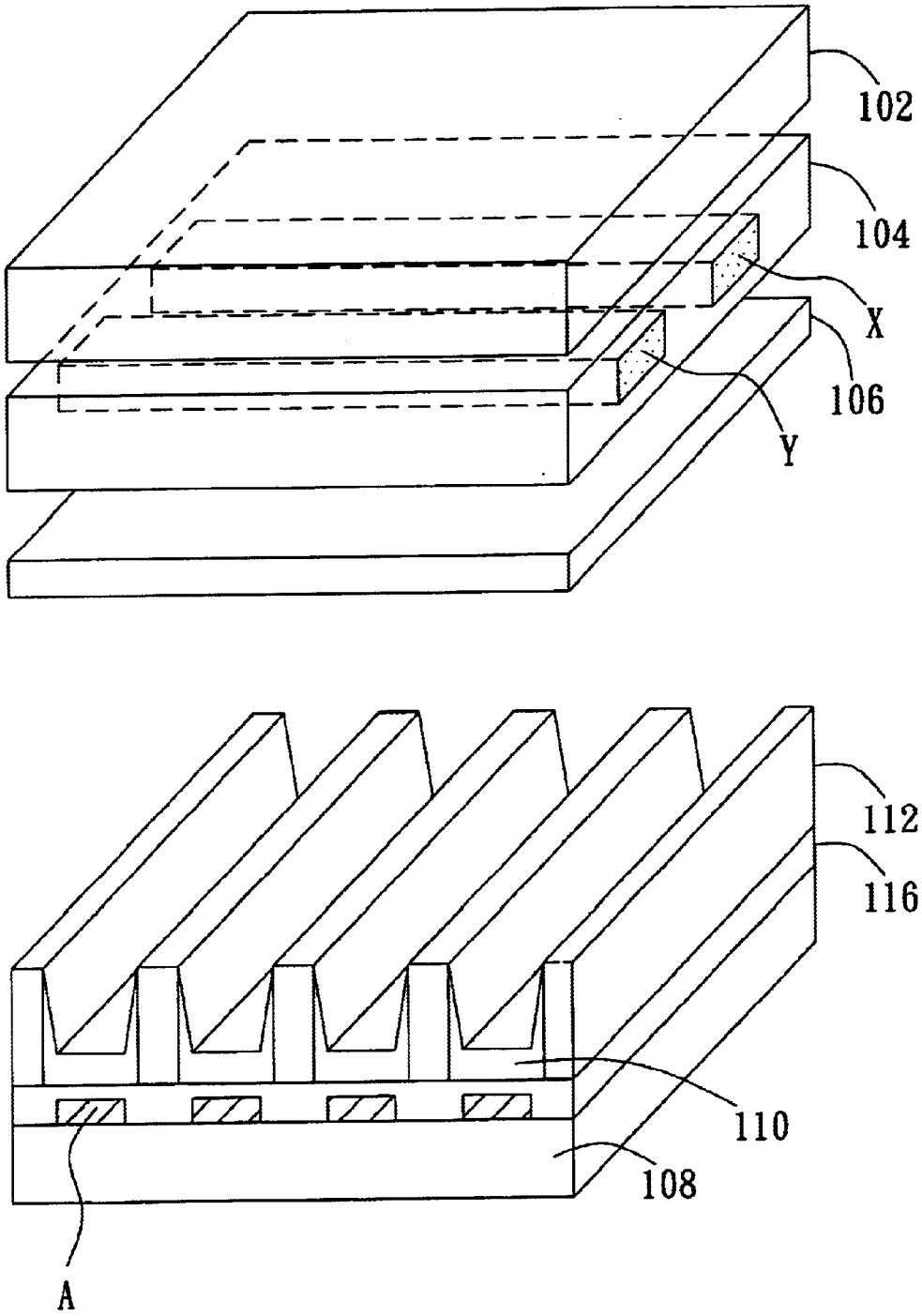
FIG. 1(PRIOR ART)
FIG. 1 shows a three-dimensional diagram of a conventional plasma display panel.
Figure 2:
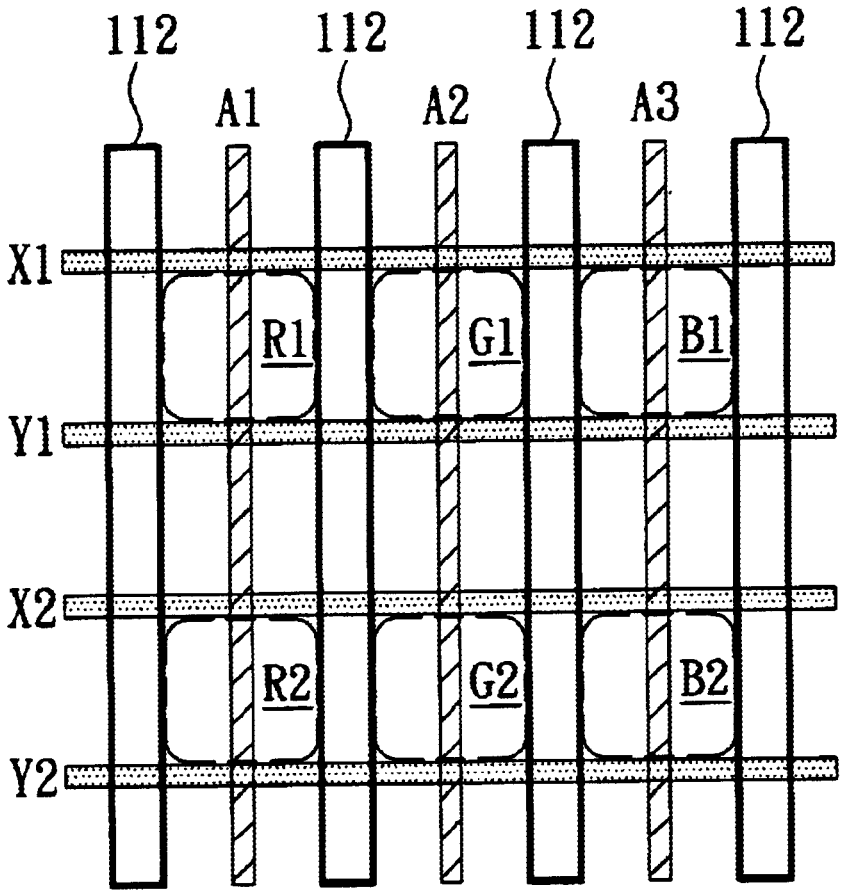
FIG. 2(PRIOR ART)
FIG. 2 is a schematic diagram illustrating the relation between several display units of horizontal arrangement and each electrode of a plasma display panel as shown in FIG. 1.
Figure 3:
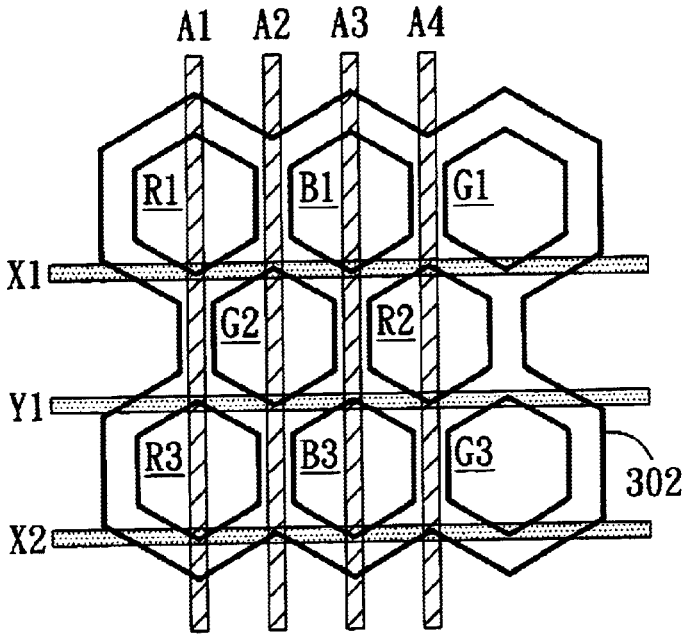
FIG. 3(PRIOR ART)
FIG. 3 is a schematic diagram illustrating a conventional relation between several display units of triangle arrangement and each electrode.
Figure 4:
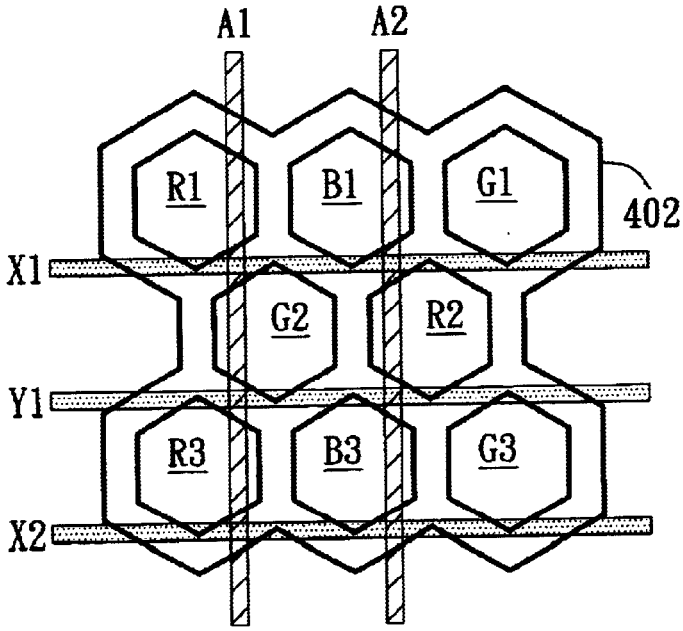
FIG. 4 is a schematic diagram illustrating a mutual relationship between plural display units of triangle arrangement and each electrode according to the first embodiment of the invention.

Refer to FIG. 4, a schematic diagram illustrating a mutual relationship between several display units of triangle arrangement and each electrode according to the first embodiment of the invention. The plasma display panel according to the invention includes a number of sustaining electrodes X, a number of scanning electrodes Y, a number of data electrodes A and a number of display units. Take sustaining electrodes X1 to X2, scanning electrode Y1, data electrodes A1 to A2, red display units R1 to R3, green display units G1 to G3 and blue display units B1 to B3 for example. Sustaining electrode X1 and scanning electrode Y1 form the first electrode combination (X1+Y1) while sustaining electrode X2 and scanning electrode Y1 form the second electrode combination (X2+Y1). Data electrodes A1 to A2 are disposed along a direction approximately orthogonal to sustaining electrodes X1 to X2 and scanning electrode Y1. Each display unit is separated by a barrier rib, wherein the barrier rib can be a honeycomb type barrier rib 402 with display units being arranged in the form of a honeycomb.

For example, green display unit G2 is controlled by data electrode A1 and the first electrode combination (X1+Y1) while red display unit R2 is controlled by data electrode A2 and the first electrode combination (X1+Y1); red display unit R3 is controlled by data electrode A1 and the second electrode combination (X2+Y1) while blue display unit B3 is controlled by data electrode A2 and the second electrode combination (X2+Y1). Display units lined up in a row alternate with display units lined up in adjacent rows, i.e., display units arranged in two adjacent rows but correspond to the same data electrode will not be lined up in the same straight line, but rather, these display units have relative displacement along horizontal direction. For example, green display unit G2 and red display unit R3, the corresponding display units of data electrode A1, are adjacent and alternately arranged display units with relative displacement existing along horizontal direction. In FIG. 4, green display unit G2 is disposed between red display unit R3 and blue display unit B3.

By disposing data electrodes in locations passing through two adjacent and alternately arranged display units, the invention uses only one data electrode to control two adjacent and alternately arranged display units to reduce the required number of data electrodes. In the first embodiment of FIG. 4, data electrodes are of linear type and are orthogonal to these sustaining electrodes and scanning electrodes.

Since two adjacent and alternately arranged display units are controlled by the same data electrode and scanning electrode, the display units need to be lighted individually during two driving procedure. The driving method for the plasma display panel of the invention is exemplified below using green display unit G2 and red display unit R3 as an example. First, during an erasing period, erase display data for all display units. Next, during the first addressing period, sequentially scan scanning electrodes Y, and select the display units to be lighted by enabling data electrodes A. For instance, when scanning electrode Y1 is enabled, select green display unit G2 and red display unit R3 at the same time by enabling data electrode A1. After that, during the first discharge sustaining period, continuously light one of the two selected display units. For instance, by providing an alternating voltage to the first electrode combination (X1+Y1), only the selected green display unit G2 is lighted continuously. Similarly, within the second addressing period, sequentially scan scanning electrodes Y, and select the display unit to be lighted by enabling data electrodes A. For instance, when scanning electrode Y1 is enabled, select again green display unit G2 and red display unit R3 at the same time by enabling data electrode A1. After that, during the second discharge sustaining period, continuously light one of the two selected display units. For instance, by providing an alternating voltage to the second electrode combination (X2+Y1), only the selected red display unit R3 is lighted continuously. Thus, the two adjacent and alternately arranged display units can be light respectively.

The color differentiation of the eyes depends on the accumulated duration of color illumination. Although green display unit G2 and red display unit R3 are lighted at different time points, this driving method still achieves the same display performance with that of a conventional plasma display panel due to the visual accumulation effect.

In the invention, data electrodes are not limited to the linear type as shown in FIG. 4: data electrodes of bent types also would do. Various patterns of bent type data electrodes are disclosed in FIG. 5 to FIG. 7 below.

The Second Embodiment

Figure 5:
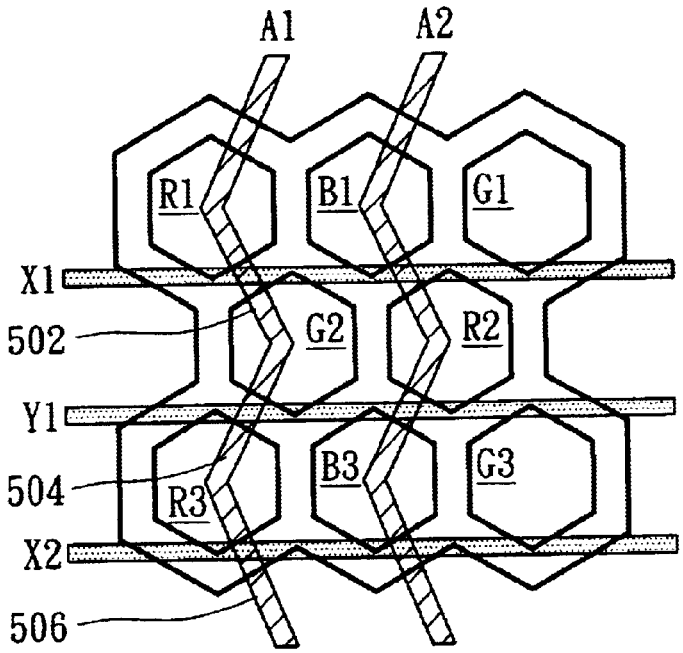
FIG. 5 is a schematic diagram illustrating a relation between several display units of triangle arrangement and each electrode according to the second embodiment of the invention.

Refer to FIG. 5, a schematic diagram illustrating a relation between several display units of triangle arrangement and each electrode according to the second embodiment of the invention. In the second embodiment, data electrodes are composed of line segments disposed along two different directions, for example, line segment 502 along the first direction and line segment 504 along the second direction, wherein line segments 502, 504 and 506 are linked sequentially. The joint linking line segment 502 and line segment 504 is disposed in green display unit G2 while the joint linking line segment 504 and line segment 506 is disposed in red display unit R3.

The Third Embodiment

Figure 6:
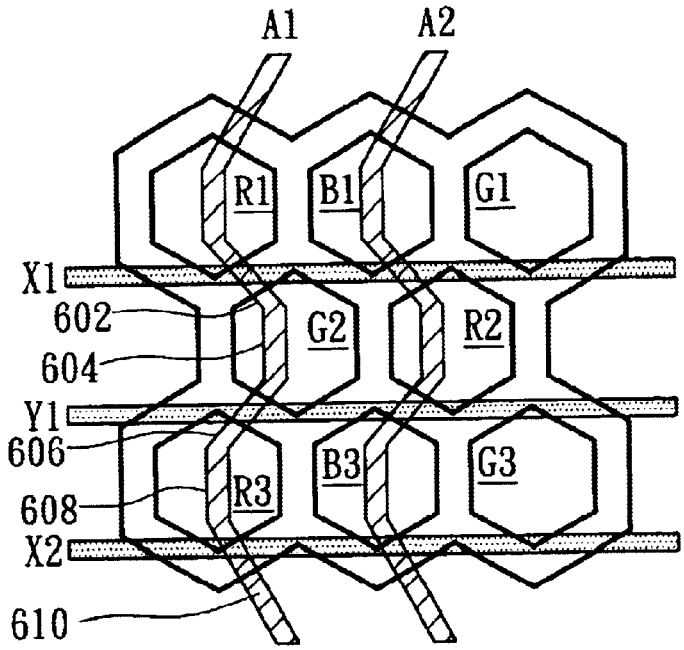
FIG. 6 is a schematic diagram illustrating a relation between several display units of triangle arrangement and each electrode according to the third embodiment of the invention.

Refer to FIG. 6, a schematic diagram illustrating a relation between several display units of triangle arrangement and each electrode according to the third embodiment of the invention. In the third embodiment, data electrodes are composed of line segments disposed in along three different directions, for example, line segments 602 and 610 of along the first direction, line segments 604 and 608 of along the second direction, and line segment 606 of along the third direction, wherein line segments 602, 604, 606, 608 and 610 are linked sequentially. The joint linking line segment 602 and line segment 604 as well as the joint linking line segment 604 and line segment 606 are disposed in green display unit G2, while the joint linking line segment 606 and line segment 608 as well as the joint linking line segment 608 and line segment 610 are disposed in red display unit R3.

The Fourth Embodiment

Figure 7:
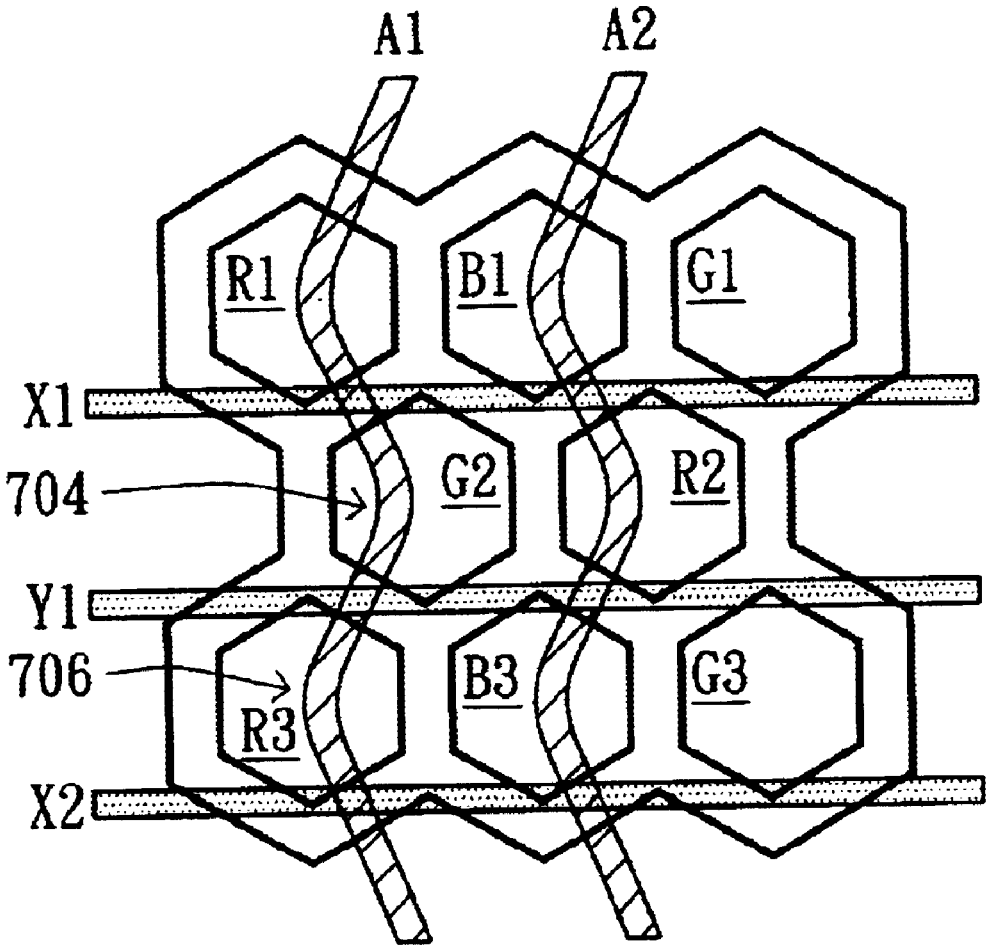
FIG. 7 is a schematic diagram illustrating a relation between several display units of triangle arrangement and each electrode according to the fourth embodiment of the invention.

Refer to FIG. 7, a schematic diagram illustrating a relation between several display units of triangle arrangement and each electrode according to the fourth embodiment of the invention. In the fourth embodiment, data electrodes are of wave type with the crest section 704 and trough section 706 being disposed in green display unit G2 and red display unit R3 respectively.

The driving methods used in the second to the fourth embodiments are the same with that used in the first embodiment and are not reiterated here.

The Fifth Embodiment

Figure 8:
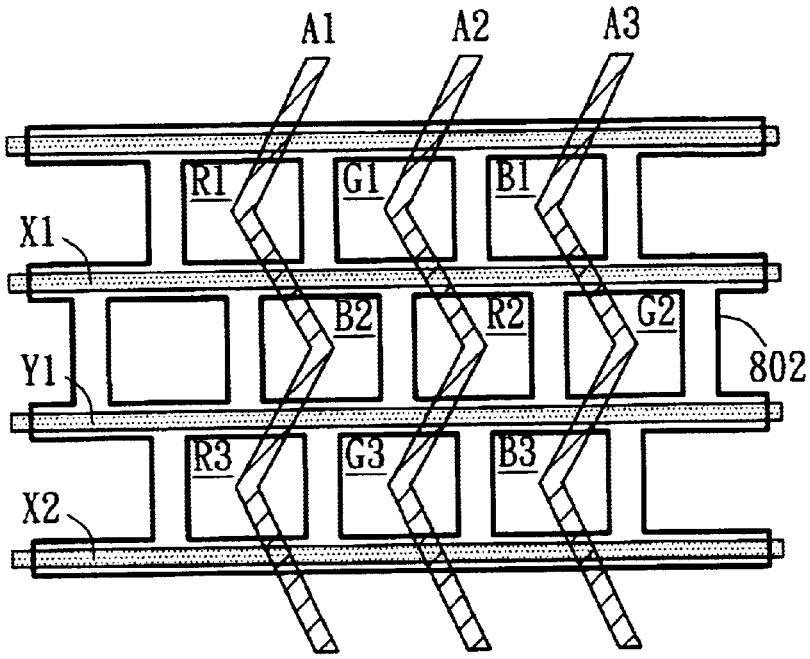
FIG. 8 is a schematic diagram illustrating a relation between several display units of triangle arrangement and each electrode according to the fifth embodiment of the invention.

Refer to FIG. 8, a schematic diagram illustrating a relation between several display units of triangle arrangement and each electrode according to the fifth embodiment of the invention. The barrier rib used in the plasma display panel according to the invention is not limited to the honeycomb type barrier rib as shown in FIG. 4. Barrier ribs of other types, approximate polygonal type or approximate circular type for example, will also achieve the object of the invention by alternately arranging display units of two adjacent rows. As shown in FIG. 8, the barrier rib according to the invention can also be an alternating grid type barrier rib 802. In this embodiment, each display unit approximates a rectangular while display units in two adjacent rows are alternately arranged.

The Sixth Embodiment

Figure 9:
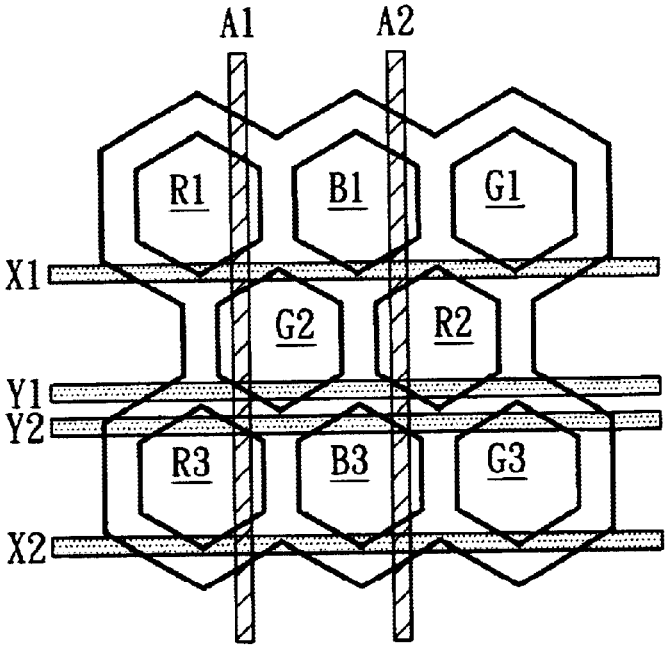
FIG. 9 is a schematic diagram illustrating a relation between several display units of triangle arrangement and each electrode according to the sixth embodiment of the invention.

Refer to FIG. 9, a schematic diagram illustrating a relation between several display units of triangle arrangement and each electrode according to the sixth embodiment of the invention. In the first embodiment of FIG. 4, scanning electrode Y1 is shared by green display unit G2 and red display unit R3. According to the spirit of the invention, display units in different rows can be controlled by different scanning electrodes. As it is shown in FIG. 9, green display unit G2 and red display unit R3 can be controlled by scanning electrode Y1 and Y2 respectively. Sustaining electrode X1 and scanning electrode Y1 form the first electrode combination (X1+Y1) while sustaining electrode X2 and scanning electrode Y2 form the second electrode combination (X2+Y2). The driving method according to the embodiment is exemplified below. First, sequentially scan scanning electrodes Y1 and Y2. Next, by enabling data electrode A2, select green display unit G2 and red display unit R3 when scanning electrodes Y1 and Y2 have been respectively enabled. Last, provide an alternating voltage to the first electrode combination (X1+Y1) and the second electrode combination (X2+Y2) respectively, so the selected display units green display unit G2 and red display unit R3 can be lighted continuously.

The Seventh Embodiment

Figure 10A:
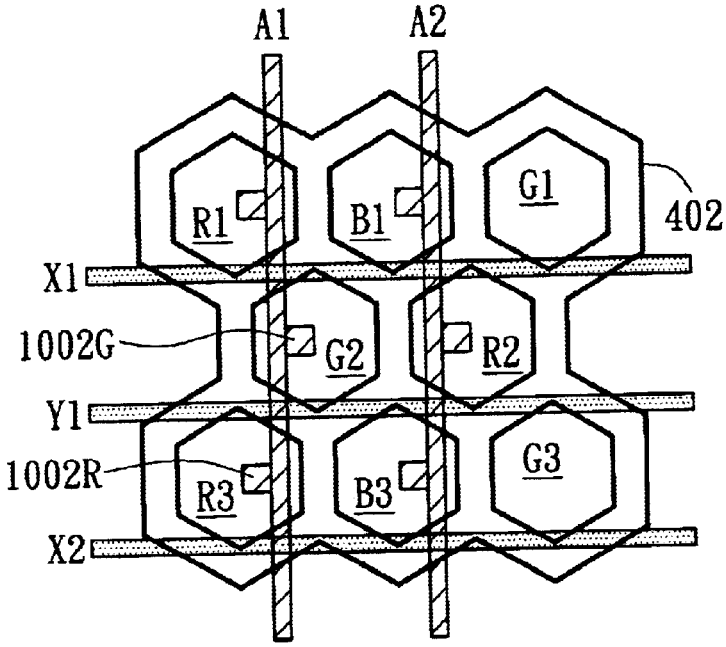
FIGS. 10A to 10C are schematic diagrams illustrating a relation between several display units of triangle arrangement and each electrode according to the seventh embodiment of the invention.
Figure 10B:
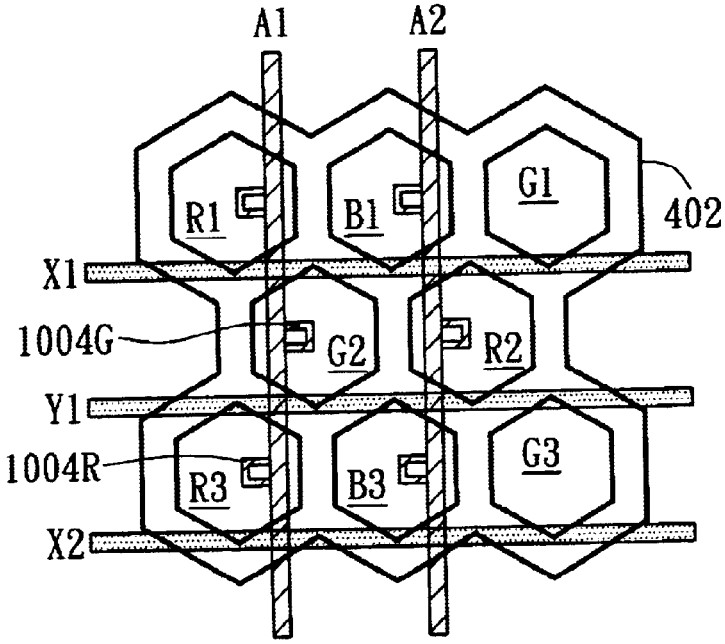
Figure 10C:
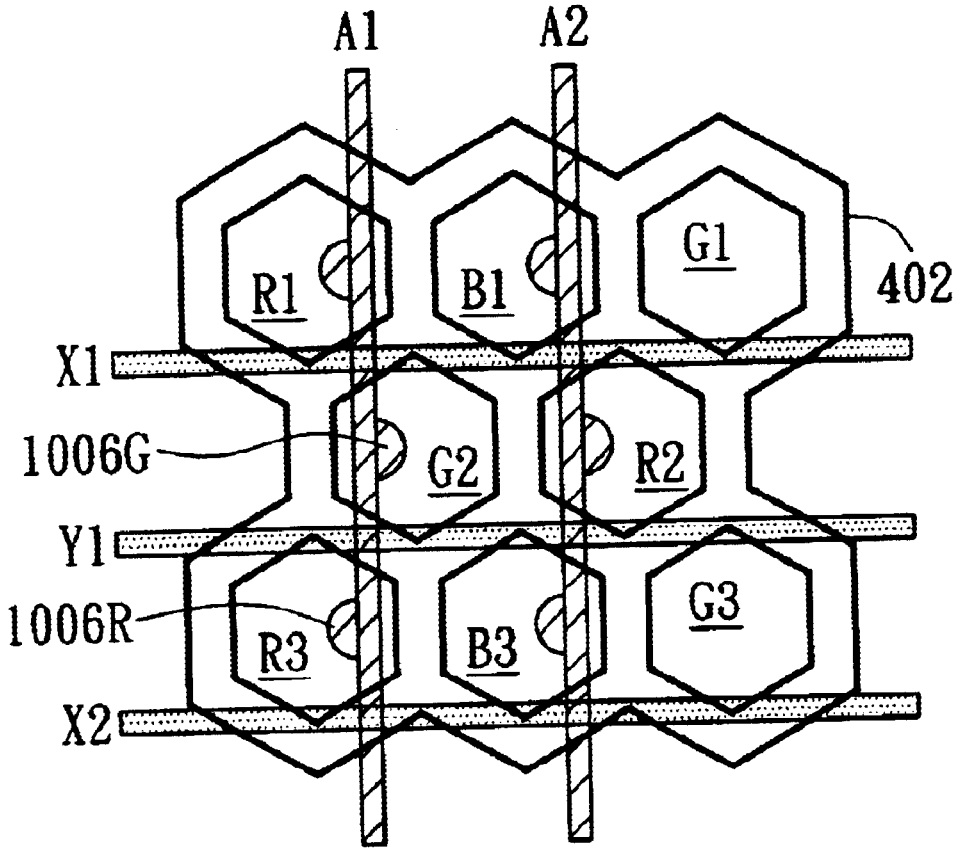

Refer to FIGS. 10A to 10C, three schematic diagrams illustrating a relation between several display units of triangle arrangement and each electrode according to the seventh embodiment of the invention. Apart from linear type design, data electrodes in the seventh embodiment according to the invention can be designed to have a number of protrusions which are disposed in corresponding display units. Take data electrode A1 for example. Data electrode A1 has a number of rectangular protrusions, rectangular protrusion 1002G and 1002R for instance, wherein 1002G and 1002R extends to the center of green display unit G2 and the center of red display unit R3 respectively. Thus the data electrodes can have better driving ability to the display units.

Apart from rectangular type, protrusions can have various types of design as well, the ring type and the semi-circular type as shown in FIGS. 10B and 10C for instance. In FIG. 10B, ring protrusions 1004G and 1004R extends to the center of green display unit G2 and the center of red display unit R3 respectively; in FIG. 10C, semi-circular protrusions 1006G and 1006R extends to the center of green display unit G2 and the center of red display unit R3 respectively.

The plasma display panel disclosed in above embodiments according to the invention uses common data electrodes for the control of two adjacent and alternately arranged display units, reducing the required number of data electrodes and lowering the manufacturing cost accordingly.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A plasma display panel, comprising:

a plurality of sustaining electrodes and a plurality of scanning electrodes with the sustaining electrodes and scanning electrodes forming at least a first electrode combination and a second electrode combination which are adjacent to each other, each electrode combination including one sustaining electrode and one scanning electrode;

a data electrode disposed along a direction approximately orthogonal to the sustaining electrodes and scanning electrodes;

a first display unit which corresponds to a first primary color and is controlled by the data electrode and the first electrode combination; and a second display unit which corresponds to a second primary color and is controlled by the data electrode and the second electrode combination;

wherein the first display unit and the second display unit are adjacent and alternately arranged.

2. The plasma display panel according to claim 1, wherein the first electrode combination includes a first sustaining electrode and a first scanning electrode while the second electrode combination includes a second sustaining electrode and the first scanning electrode.

3. The plasma display panel according to claim 1, wherein the first electrode combination includes a first sustaining electrode and a first scanning electrode while the second electrode combination includes a second sustaining electrode and a second scanning electrode.

4. The plasma display panel according to claim 1, wherein the data electrode is of linear type and is orthogonal to the sustaining electrodes and scanning electrodes.

5. The plasma display panel according to claim 1, wherein the electrode combination is of bent type.

6. The plasma display panel according to claim 5, wherein the data electrode has at least a first line segment, a second line segment and a third line segment which are linked sequentially with the joint linking the first line segment and the second line segment being disposed in the first display unit while the joint linking the second line segment and the third line segment being disposed in the second display unit.

7. The plasma display panel according to claim 5, wherein the electrode combination is of wave type.

8. The plasma display panel according to claim 5, wherein the data electrode has at least a first line segment, a second line segment, a third line segment, a fourth line segment and a fifth line segment which are linked sequentially with the joint linking the first line segment and the second line segment and the joint linking the second line segment and the third line segment being disposed in the first display unit while the joint linking the third line segment and the fourth line segment and the joint linking the fourth line segment and the fifth line segment being disposed in the second display unit.

9. The plasma display panel according to claim 1, wherein the first display unit and the second display unit are separated by a barrier rib.

10. The plasma display panel according to claim 9, wherein the barrier rib is a honeycomb type barrier rib.

11. The plasma display panel according to claim 9, wherein the barrier rib is an alternating grid type barrier rib.

12. The plasma display panel according to claim 1, wherein the data electrode has a first protrusion and a second protrusion, the first protrusion is disposed in a location corresponding to the first display unit while the second protrusion is disposed in a location corresponding to the second display unit.

13. The plasma display panel according to claim 12, wherein the first protrusion and the second protrusion are rectangular, ring or semi-circular.

14. A plasma display panel with a plurality of display units, the display units being of triangle arrangement, and having a first display unit and a second display unit, which are adjacent and alternately arranged, with the first display unit corresponding to a first primary color and the second display unit corresponding to a second mono-primary color, comprising:

a first sustaining electrode and a second sustaining electrode;

a scanning electrode, which, being disposed between the first sustaining electrode and the second sustaining electrode, is parallel to the first sustaining electrode and the second sustaining electrode respectively; and a data electrode which is disposed along a direction approximately orthogonal to the sustaining electrodes;

wherein the first display unit is controlled by the first sustaining electrode, the scanning electrode and the data electrode while the second display unit is controlled by the second sustaining electrode, the scanning electrode and the data electrode.

15. The plasma display panel according to claim 14, wherein the data electrode is of linear type and is approximately orthogonal to the sustaining electrodes and scanning electrodes.

16. The plasma display panel according to claim 14, wherein the data electrode is of bent type.

17. The plasma display panel according to claim 16, wherein the data electrode has at least a first line segment, a second line segment and a third line segment which are linked sequentially with the joint linking the first line segment and the second line segment being disposed in the first display unit while the joint linking the second line segment and the third line segment being disposed in the second display unit.

18. The plasma display panel according to claim 16, wherein the data electrode is of wave type.

19. The plasma display panel according to claim 16, wherein the data electrode has at least a first line segment, a second line segment, a third line segment, a fourth line segment and a fifth line segment which are linked sequentially with the joint linking the first line segment and the second line segment and the joint linking the second line segment and the third line segment being disposed in the first display unit while the joint linking the third line segment and the fourth line segment and the joint linking the fourth line segment and the fifth line segment being disposed in the second display unit.

20. The plasma display panel according to claim 14, wherein the data electrode has a first protrusion and a second protrusion, the first protrusion is disposed in a location corresponding to the first display unit while the second protrusion is disposed in a location corresponding to the second display unit.

21. The plasma display panel according to claim 20, wherein the first protrusion and the second protrusion are rectangular, ring or semi-circular.

* * * * *